US011287131B2

(12) United States Patent
Blaauwwiekel

(10) Patent No.: US 11,287,131 B2
(45) Date of Patent: Mar. 29, 2022

(54) METHOD FOR OPERATING A GAS BURNER APPLIANCE

(71) Applicant: Ademco Inc., Golden Valley, MN (US)

(72) Inventor: Piet Blaauwwiekel, Sleen (NL)

(73) Assignee: Ademco Inc., Golden Valley, MN (US)

( * ) Notice: Subject to any disclaimer, the term of this patent is extended or adjusted under 35 U.S.C. 154(b) by 314 days.

(21) Appl. No.: 16/553,489

(22) Filed: Aug. 28, 2019

(65) Prior Publication Data

US 2020/0072463 A1 Mar. 5, 2020

(30) Foreign Application Priority Data

Aug. 28, 2018 (EP) ..... 18191195

(51) Int. Cl.

| | |
|---|---|
| ***F23N 1/02*** | (2006.01) |
| ***F23D 14/06*** | (2006.01) |
| ***F23N 5/12*** | (2006.01) |
| ***F24C 3/12*** | (2006.01) |
| ***F23N 3/08*** | (2006.01) |

(52) U.S. Cl.

CPC ..... *F23N 1/025* (2013.01); *F23D 14/06* (2013.01); *F23N 3/087* (2013.01); *F23N 5/126* (2013.01); *F24C 3/122* (2013.01); *F23N 2227/20* (2020.01); *F23N 2237/10* (2020.01); *F23N 2239/04* (2020.01); *F23N 2241/08* (2020.01)

(58) Field of Classification Search

CPC ..... F23N 1/025; F23N 1/027; F23N 3/087; F23N 5/126; F23N 2227/20; F23N 2241/08; F23N 2241/02; F23N 2241/04; F23N 2241/06; F23N 2237/10; F23N 2239/04; F23D 14/06; F23D 14/04; F23C 7/008; F23K 5/007; F23K 2400/201; F24C 3/122

USPC ..... 431/12, 90; 236/25 A

See application file for complete search history.

(56) References Cited

U.S. PATENT DOCUMENTS 2,258,515 A * 10/1941 Mowat ..... F23D 14/60 431/9

4,431,132 A * 2/1984 Edmundson ..... F23N 1/007 122/14.21

(Continued)

FOREIGN PATENT DOCUMENTS

EP 0450173 A1 * 10/1991 ..... F23N 1/027

EP 1183483 A1 3/2002

(Continued)

OTHER PUBLICATIONS

Extended Search Report from counterpart European Application No. 18191195.9, dated Feb. 12, 2019, 4 pp.

*Primary Examiner* — Steven B McAllister

*Assistant Examiner* — Daniel E. Namay

(74) *Attorney, Agent, or Firm* — Shumaker & Sieffert, P.A.

(57) ABSTRACT

In an example method for operating a gas burner appliance, during burner-on-phases, a gas/air mixture having a defined mixing ratio of gas and air is provided to a burner chamber. The gas/air mixture is provided by a mixing device that mixes an air flow with a gas flow. The air flow is provided by a fan in such a way that the fan speed of the fan depends on a desired burner load. During burner-on-phases, the combustion quality is monitored on the basis of a signal provided by a combustion quality sensor. The defined mixing ratio of gas and air of the gas/air mixture can be calibrated on the basis of the signal provided by the combustion quality sensor.

7 Claims, 1 Drawing Sheet

(56) References Cited

U.S. PATENT DOCUMENTS

| | | | | | |
|---|---|---|---|---|---|
| 4,793,798 | A * | 12/1988 | Sabin | F23D 14/22 431/90 |
| 5,938,425 | A * | 8/1999 | Damrath | F23N 1/005 431/62 |
| 6,604,938 | B1 | 8/2003 | Blaauwwiekel et al. | |
| 11,073,281 | B2 * | 7/2021 | Hazzard | F23N 5/242 |
| 2015/0354810 | A1 * | 12/2015 | Nakatani | F23D 14/34 431/354 |
| 2016/0076767 | A1 * | 3/2016 | Super | F23N 1/002 431/76 |
| 2017/0082286 | A1 * | 3/2017 | Trimble | F23D 14/22 |
| 2017/0284663 | A1 * | 10/2017 | Nonoyama | F23D 14/06 |
| 2017/0292697 | A1 * | 10/2017 | Shimazu | F23D 14/02 |
| 2019/0203936 | A1 * | 7/2019 | Hazzard | F23N 5/242 |
| 2019/0293281 | A1 * | 9/2019 | Nonoyama | F23N 1/027 |
| 2019/0346133 | A1 * | 11/2019 | Kanazawa | F23K 5/007 |

FOREIGN PATENT DOCUMENTS

| | | | | |
|---|---|---|---|---|
| EP | 2667097 | A1 | 11/2013 | |
| EP | 3059496 | A1 | 8/2016 | |
| EP | 3415817 | A1 * | 12/2018 | B01F 5/0428 |
| FR | 2654191 | A1 * | 5/1991 | F23D 14/62 |
| JP | S62178815 | A | 8/1987 | |
| JP | 2017187177 | A * | 10/2017 | F23D 14/60 |
| JP | 2019196864 | A * | 11/2019 | F23N 1/02 |
| WO | 2016181212 | A1 | 11/2016 | |

* cited by examiner

METHOD FOR OPERATING A GAS BURNER APPLIANCE

CROSS-REFERENCE TO RELATED APPLICATIONS

This application claims the benefit of European Patent Application No. 18191195.9 filed Aug. 28, 2018, the disclosure of which is herein incorporated by reference in its entirety.

The present patent application relates to a method for operating a gas burner appliance.

EP 2 667 097 A1 discloses a method for operating a gas burner appliance. During burner-on-phases, a defined gas/air mixture having a defined mixing ratio of gas and air is provided to a burner chamber for combusting the defined gas/air mixture. The defined gas/air mixture is provided by a mixing device mixing an air flow provided by an air duct with a gas flow provided by a gas duct. The mixing device is provided by a Venturi nozzle. The air flow flowing through the air duct is provided by fan in such a way that the fan speed of the fan depends on a desired burner load of the gas burner appliance, wherein the fan speed range of the fan defines a so-called modulation range of the gas burner appliance.

According to EP 2 667 097 A1 the defined mixing ratio of gas and air of the defined gas/air mixture is kept constant over the entire modulation range of the gas burner appliance by a pneumatic controller of a gas regulation valve being positioned with the gas duct. The pneumatic controller uses a pressure difference between the gas pressure of the gas flow in the gas pipe and a reference pressure, wherein either the air pressure of the air flow in the air duct or the ambient pressure is used as reference pressure, and wherein the pressure difference between the gas pressure of the gas flow in the gas pipe and the reference pressure is determined and controlled pneumatically. The combustion quality is monitored on basis of a signal provided by a combustion quality sensor like a flame ionization sensor.

According to EP 2 667 097 A1, during burner-on-phases of the gas burner appliance, the mixing ratio of the gas/air mixture can be calibrated to different gas qualities on basis of the signal provided by the flame ionization sensor. The flame ionization sensor is used to calibrate the gas/air mixture to different gas qualities. The control of the mixing ratio of the gas/air mixture over the modulation range of the gas burner is independent from the flame ionization current.

As mentioned above, EP 2 667 097 A1 discloses a method for operating a gas burner appliance in which the defined mixing ratio of the gas/air mixture is kept constant over the entire modulation range of the gas burner. Only in a calibration mode of the gas burner appliance during a burner-on-phase, the mixing ratio of the gas/air mixture is changed to compensate for a changing gas quality. After a calibration has been executed, the mixing ratio of the gas/air mixture is kept constant over the entire modulation range in a regular combustion mode of the gas burner appliance.

For calibration a position of a throttle positioned within the gas duct becomes adjusted with an offset value determined during calibration. Said throttle may be an integral element of the gas regulation valve.

The capacity range of such a burner appliance is limited due to the constraint that the maximum opening of the throttle positioned within the gas duct does not allow sufficient gas flow if the gas/air mixing device does not generate sufficient pressure drop.

If the gas/air mixing device does not generate a sufficient pressure drop, the pressure differential is not sufficient to provide a gas flow through the throttle needed for calibration even if the throttle is completely opened.

To increase the capacity range of such a burner appliance, according to the state of the art the throttle being positioned within the gas duct is adapted in size. However, using a bigger throttle within the gas duct increases the costs for the gas burner appliance. If the throttle is an integral element of the gas regulation valve, according to the state of the art the entire gas regulation valve is adapted in size.

EP 1 183 483 B1 discloses a mixing device for a gas burner appliance having two Venturi nozzles being connected in parallel. At least one of the Venturi nozzles can be shut off by a flap.

It is desired to increase the capacity range of a burner appliance without the need for a bigger throttle or without the need for a bigger gas regulation valve within the gas duct.

Against this background a novel method for operating a gas burner is provided. The method for operating a gas burner according to the invention is defined in the claim 1.

The mixing device of the gas burner appliance to be operated in accordance with the present invention has at least at least two Venturi nozzles being connected in parallel.

The calibration of the gas/air mixture is performed in such a way that for calibration at least one of the Venturi nozzles of the mixing device is closed while at least one of the Venturi nozzles of the mixing device is opened.

With the invention relatively small throttles or gas regulation valves with relatively small throttles which are used in burner appliances with relatively low capacity can be used in burner appliances with increased capacity. In this way there is no need for bigger throttles or gas regulation valves with bigger throttles.

Existing throttles or existing gas regulation valves with an integral throttle can be used avoiding the need for the development of bigger throttles or gas regulation valves with a bigger throttle.

During a regular combustion mode of the gas burner appliance—meaning in burner-on-phases in which no calibration is performed—the number of opened and closed Venturi nozzles of the mixing device may depend on the burner load. At relatively high burner loads more Venturi nozzles of the mixing device may be opened than at relatively low burner loads.

During calibration an offset value is determined to adjust the position of the throttle within the gas duct. Said offset value is determined during a calibration mode of the gas burner appliance—meaning in a burner-on-phase in which calibration is performed—with a defined number of the Venturi nozzles of the mixing device being closed and a defined number of the Venturi nozzles of the mixing device being opened. Said offset value is used without adjustment for a regular combustion mode of the gas burner appliance in which the same number of the Venturi nozzles of the mixing device is closed and the same defined number of the Venturi nozzles of the mixing device is opened as in the calibration mode of the gas burner appliance in which the offset value has been determined. Said offset value is used with adjustment for a regular combustion mode of the gas burner appliance in which a different number of the Venturi nozzles of the mixing device is closed and a different number of the Venturi nozzles of the mixing device is opened as in the calibration mode of the gas burner appliance in which the off-set value has been determined. This allows a very beneficial operation of a burner appliance with an increased capacity range but making use of throttles known from burner appliances having a lower capacity.

For the adjustment of said offset value the offset value may be multiplied with a factor depending from the ratio between the flow section provided by the Venturi nozzles being opened during the regular combustion mode of the gas burner appliance and the flow section provided by the Venturi nozzles be opened during the calibration mode of the gas burner appliance in which the offset value has been determined. This adjustment of the offset value is preferred and can be done in a very simple and reliable way.

Preferred developments of the invention are provided by the dependent claims and the description which follows. Exemplary embodiments are explained in more detail on the basis of the drawing, in which:

Figure 1:
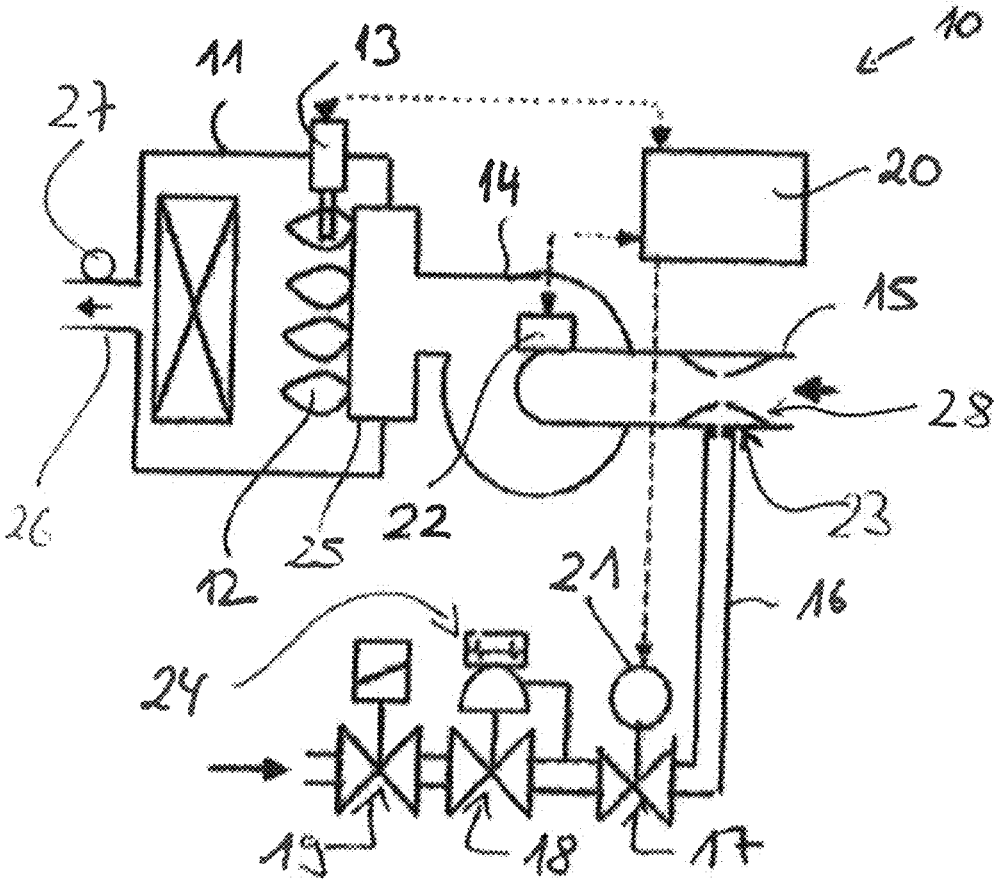
FIG. 1 shows a schematic view of a gas burner appliance.

FIG. 1 shows a schematic view of a gas burner appliance 10. The same comprises a gas burner chamber 11 with a gas burner surface 25 in which combustion of a defined gas/air mixture having a defined mixing ratio of gas and air takes place during burner-on phases of the gas burner appliance 10.

The combustion of the gas/air mixture results into flames 12 monitored by a combustion quality sensor, namely by a flame rod 13.

The defined gas/air mixture is provided to the burner chamber 11 of the gas burner appliance 10 by mixing an air flow with a gas flow.

A fan 14 sucks in air flowing through an air duct 15 and gas flowing though a gas duct 16.

A gas regulating valve 18 for adjusting the gas flow through the gas duct 16 and preferably a gas safety valve 19 are assigned to the gas duct 16.

The defined gas/air mixture having the defined mixing ratio of gas and air is provided to the burner chamber 11 of the gas burner appliance 10. The defined gas/air mixture is provided by mixing the air flow provided by an air duct 15 with a gas flow provided by a gas duct 16. The air flow and the gas flow become preferably mixed by a mixing device 23.

The quantity of the air flow and thereby the quantity of the gas/air mixture flow is adjusted by the fan 14, namely by the speed of the fan 14. The fan speed can be adjusted by an actuator 22 of the fan 14. The fan speed of the fan 14 is controlled by a controller 20 generating a control variable for the actuator 22 of the fan 14.

The defined mixing ratio of the defined gas/air mixture is controlled by the gas regulating valve 18, namely by a pneumatic controller 24 of the same. The pneumatic controller 24 of the gas regulating valve 18 controls the opening/closing position of the gas valve 18.

The position of the gas valve 18 is adjusted by the pneumatic controller 24 on basis of a pressure difference between the gas pressure of the gas flow in the gas pipe 16 and a reference pressure. The gas regulating valve 18 is controlled by the pneumatic controller 24 in such a way that at the outlet pressure of the gas valve 18 is equal to the reference pressure.

In FIG. 1, the ambient pressure serves as reference pressure. However, it is also possible to use the air pressure of the air flow in the air duct 15 as reference pressure.

The pressure difference between the gas pressure and the reference pressure is determined pneumatically by pneumatic sensor of the pneumatic controller 24.

The mixing ratio of the defined gas/air mixture is controlled by the pneumatic controller 24 in such a way that over the entire modulation range of the gas burner appliance 10 the defined mixing ratio of the defined gas/air mixture is kept constant.

A modulation of "1" means that the fan 14 is operated at maximum fan speed (100% of maximum fay speed) and thereby at full-load of the gas burner appliance 10. A modulation of "2" means that the fan 14 is operated at 50% of the maximum fan speed and a modulation of "5" means that the fan 14 is operated at 20% of the maximum fan speed.

By changing the fan speed of the fan 14, the load of the gas burner appliance 10 can be adjusted. Over the entire modulation range of the gas burner appliance 10 the defined mixing ratio of the defined gas/air mixture is kept constant.

As described above, the mixing ratio of the defined gas/air mixture is controlled during burner-on phases by the pneumatic controller 24 so that over the entire modulation range of the gas burner appliance 10 the defined mixing ratio of the gas/air mixture is kept constant.

During burner-on phases the defined mixing ratio of gas and air of the defined gas/air mixture can be calibrated.

The calibration is performed by adjusting a position of a throttle 17 within the gas duct 16.

The throttle 17 may be an integral element of the gas regulation valve 18. The throttle position of the throttle 17 can be adjusted by an actuator 21 assigned to the throttle 17. The controller 20 controls the actuator 21 and thereby the throttle position of the throttle 17 during calibration.

The absolute throttle position of the throttle 17 after calibration can be determined in different ways. With use of a stepper motor as actuator 21, the actual absolute throttle position of the throttle 17 can be determined by counting steps of the stepper motor. With use of a solenoid as actuator 21, the actual absolute throttle position of the throttle 17 can be determined by measuring/controlling the electrical current of the same. It is also possible to determine the absolute throttle position of the throttle 17 after calibration by using a position feedback provided by a sensing element like a Hall sensor assigned to the throttle 17.

Independent from how the absolute throttle position of the throttle 17 after calibration is determined, during calibration an offset value is determined to adjust the position of the throttle 17 within the gas duct 16.

As explained above, during burner-on-phases of the gas burner appliance 10 a defined gas/air mixture is combusted with the gas burner chamber 11 of the gas burner appliance 10. During a regular combustion mode of the gas burner appliance 10—in which no calibration takes place—the fan speed is adjusted to the desired burner load and the mixing ratio of the gas/air mixture is controlled, namely kept constant, by the pneumatic controller 24 of the gas regulation valve 18. The combustion quality is motioned by a sensor.

The combustion quality can be monitored by the ionization sensor 13. Alternatively, combustion quality can be monitored by an exhaust gas sensor 27 assigned to an exhaust gas chimney 26 of the gas burner appliance 10.

If combustion quality becomes poor, the mixing ratio of the gas/air mixture becomes calibrated in a calibration mode of the gas burner appliance 10. The regular combustion mode and the calibration mode belong both to burner-on-phases of the gas burner appliance 10.

The mixing device 23 of the gas burner appliance 10 has at least two Venturi nozzles 28 being connected in parallel.

Figure 2:
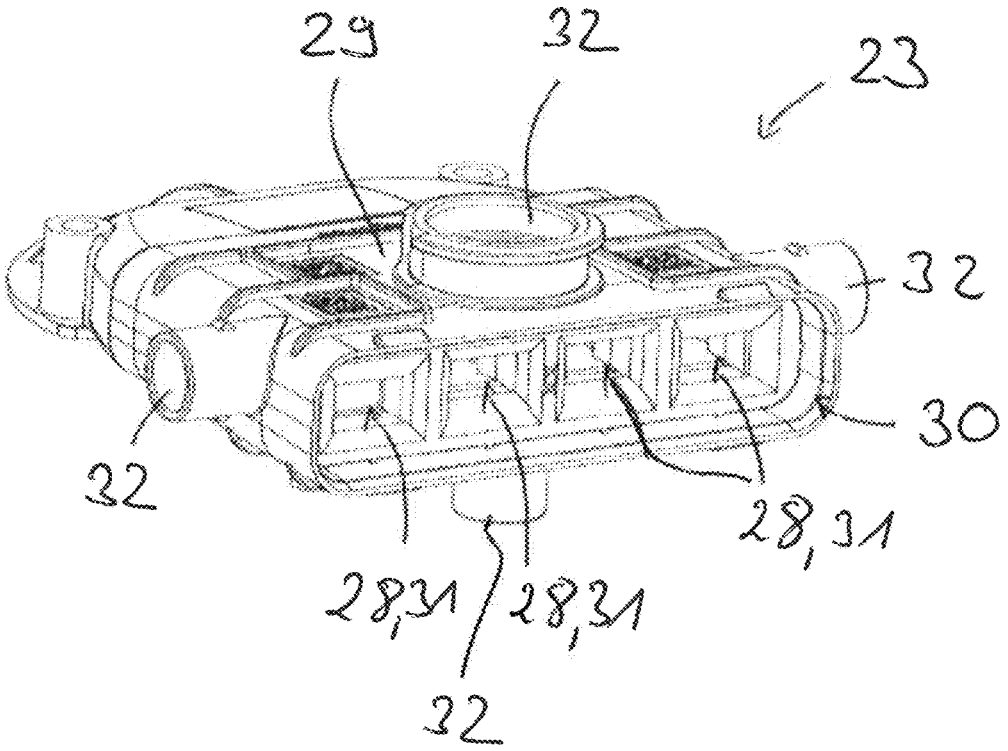
FIG. 2 shows a detail of the gas burner appliance of FIG. 1.

FIG. 2 shows an example of such a mixing device 23 having four Venturi nozzles 28 being connected in parallel.

The number of Venturi nozzles 28 being connected in parallel is of exemplary nature only. As mentioned above, the mixing device 23 has at least two Venturi nozzles 28 being connected in parallel.

The mixing device 23 has a housing 29. The Venturi nozzles 28 are all connected in parallel and are positioned side-by-side in a row with the housing 29.

The housing 29 provides an air inlet opening 30 being in communication with air inlet openings 31 of the Venturi nozzles 28. The air inlet opening 30 of the housing 29 is connected the air duct 15 or is part of the air duct 15 provided by the housing 29. The housing 29 further provides gas inlet openings 32. The gas inlet openings 32 of the housing 29 are in communication with gas inlet openings (not visible) of the Venturi nozzles 28. The different gas inlet openings 32 are provided to allow different installation scenarios for the gas/air mixing device 23. In each installation scenarios one of said gas inlet openings 32 is connected to the gas duct 16 while the other gas inlet openings 32 are inactive. The housing 29 of the mixing device 23 further provide an outlet opening (not visible) for the gas/air mixture.

At least one of the Venturi nozzles 28 can be closed and opened by an actuator (not visible).

In case of the mixing device 23 shown in FIG. 2 having four Venturi nozzles 28, three of the four Venturi nozzles 28 may be individually closable and openable by a respective actuator (not visible) while one of the Venturi nozzles 28 is permanently opened.

In this case the mixing device 23 shown in FIG. 2 can be operated with all four Venturi nozzles 28 being opened, or with three Venturi nozzles 28 being opened and one Venturi nozzle 28 being closed, or with two Venturi nozzles 28 being opened and two Venturi nozzles 28 being closed, or with one Venturi nozzle 28 being opened and three Venturi nozzles 28 being closed.

In case of the mixing device 23 shown in FIG. 2 it is also possible and preferred that two of the four Venturi nozzles 28 are permanently opened while two other Venturi nozzles 28 can be opened and closed jointly by a common actuator. In this case the mixing device 23 shown in FIG. 2 can be operated with all four Venturi nozzles 28 being opened, or with two Venturi nozzles 28 being opened and two Venturi nozzles 28 being closed.

During a regular combustion mode of the gas burner appliance 10—in which no calibration takes place—the number of opened Venturi nozzles 28 of the mixing device 23 depends on the burner load.

At relatively high burner loads more Venturi nozzles 28 of the mixing device 23 are opened than at relatively low burner loads. E.g. at full or maximum burner load corresponding to a modulation of "1" all Venturi nozzles 28 of the mixing device 23 may be opened. At or near 50% of the full or maximum burner load half of the Venturi nozzles 28 of the mixing device 23 may be opened and half of the Venturi nozzles 28 of the mixing device 23 may be closed.

For calibration of such a gas burner appliance 10, namely for calibrating the mixing ratio of gas and air of the gas/air mixture to different gas qualities during a calibration mode of the gas burner appliance 10, the calibration is performed in such a way that for calibration at least one of the Venturi nozzles 28 of the mixing device 23 is closed while at least one of the Venturi nozzles 28 of the mixing device 23 is opened.

In case of the mixing device 23 shown in FIG. 2 having four Venturi nozzles 28, if three of the four Venturi nozzles 28 can be individually closed and opened, for calibration preferably one Venturi nozzle 28 is opened and three Venturi nozzles 28 are closed.

In case of the mixing device 23 shown in FIG. 2 having four Venturi nozzles 28, if two of the four Venturi nozzles 28 can jointly be closed and opened, for calibration two Venturi nozzles 28 are opened and two Venturi nozzles 28 are closed.

As mentioned above, during calibration an offset value is determined to adjust the position of the throttle 17 within the gas duct 16.

Said offset value is determined during a calibration mode of the gas burner appliance 10 with a defined number of the Venturi nozzles 28 of the mixing device 23 being closed and a defined number of the Venturi nozzles 28 of the mixing device 23 being opened.

Said offset value is used without adjustment for a regular combustion mode of the gas burner appliance 10 in which the same number of the Venturi nozzles 28 of the mixing device 23 is closed and the same defined number of the Venturi nozzles 28 of the mixing device 23 is opened as in the calibration mode of the gas burner appliance 10 in which the offset value has been determined.

Said offset value is used with adjustment for a regular combustion mode of the gas burner appliance 10 in which a different number of the Venturi nozzles 28 of the mixing device 23 is closed and a different number of the Venturi nozzles 28 of the mixing device 23 is opened as in the calibration mode of the gas burner appliance 10 in which the off-set value has been determined.

For the adjustment of the offset value the offset value is multiplied with a factor. Said factor depends from the ratio between the flow section provided by the Venturi nozzles 28 being open during the regular combustion mode of the gas burner appliance 10 and the flow section provided by the or each Venturi nozzles be open during the calibration mode of the gas burner appliance 10 in which the offset value has been determined.

In case of the mixing device 23 shown in FIG. 2 having four Venturi nozzles 28, if two of the four Venturi nozzles 28 can jointly be closed and opened, for calibration two Venturi nozzles 28 are opened and two Venturi nozzles 28 are closed. The offset determined during said calibration with two Venturi nozzles 28 being opened and two Venturi nozzles 28 being closed will be used without adjustment for a regular combustion mode in which also two Venturi nozzles 28 are opened and two Venturi nozzles 28 are closed.

However, for a regular combustion mode in which all four Venturi nozzles 28 are opened, an adjusted offset will be used. For adjustment of the offset value the same is multiplied with a factor. Said factor depends then from the ratio between the flow section provided by all four Venturi nozzles 28 and the flow section provided by two Venturi nozzles be opened during the calibration. If the ratio of the between the flow section provided by all four Venturi nozzles 28 and the flow section provided by two Venturi nozzles be opened during the calibration is 2,0, then the factor may be 2,0.

As mentioned above, the use of a mixing device having four Venturi nozzles in parallel is only an example. The mixing device may have only two Venturi nozzles in parallel. In this case, for calibration one Venturi nozzle is closed and one Venturi nozzle is opened. In this case, during a regular combustion mode with one Venturi nozzle may be opened or two Venturi nozzles may be opened, depending on the burner load.

If during a regular combustion mode one Venturi nozzle is opened while the other Venturi nozzle is closed, the offset determined during calibration can be used without adjustment of the same. However, if during a regular combustion mode two Venturi nozzle are, the offset determined during calibration will adjusted by a factor as described above.

With the present invention, the throttle valve limitation will longer be an issue. Since the calibration will be done with at least one Venturi nozzle being closed, a higher pressure drop can be provided at the mixing device allowing a gas flow high enough to allow calibration.

LIST OF REFERENCE SIGNS

10 gas burner appliance
11 gas burner chamber
12 flame
13 flame rod
15 air duct
16 gas duct
17 throttle
18 gas valve/regulating valve
19 gas valve/safety valve
20 controller
21 actuator
22 actuator
23 mixing device
24 pneumatic controller
25 gas burner surface
26 exhaust gas chimney
27 exhaust gas sensor
28 Venturi nozzle
29 housing
30 air inlet opening of housing
31 air inlet opening of Venturi nozzle
32 gas inlet opening of housing

The invention claimed is:

1. A method for operating a gas burner appliance comprising:

providing, during burner-on-phases, defined gas/air mixture having a defined mixing ratio of gas and air to a burner chamber of the gas burner appliance for combusting the defined gas/air mixture within the burner chamber, wherein the defined gas/air mixture is provided by a mixing device mixing an air flow with a gas flow, wherein the mixing device has at least two Venturi nozzles connected in parallel;

wherein the air flow is provided by a fan in such a way that a fan speed of the fan depends on a desired burner load of the gas burner appliance, wherein a fan speed range of the fan defines a modulation range of the gas burner appliance, wherein the defined mixing ratio of gas and air of the gas/air mixture is controlled over the modulation range of the gas burner appliance by a gas regulating valve, wherein the gas regulating valve has a pneumatic controller controlling the mixing ratio of gas and air on the basis of a pressure difference between a gas pressure of the gas flow in a gas pipe and a reference pressure, wherein either an air pressure of the air flow or an ambient pressure is used as the reference pressure, wherein the pressure difference between the gas pressure and the reference pressure is determined and controlled pneumatically, wherein, during burner-on-phases, the combustion quality is monitored on the basis of a signal provided by a combustion quality sensor, wherein the defined mixing ratio of gas and air of the defined gas/air mixture can be calibrated on the basis of the signal provided by the combustion quality sensor, by adjusting a position of a throttle, and;

wherein the calibration of the gas/air mixture is performed in such a way that at least one of the Venturi nozzles of the mixing device is closed while at least one of the Venturi nozzles of the mixing device is opened.

2. The method of claim 1, wherein during a regular combustion mode of the gas burner appliance, the number of opened Venturi nozzles of the mixing device depends on the burner load.

3. The method of claim 2, wherein at relatively high burner loads more Venturi nozzles of the mixing device are opened than at relatively low burner loads.

4. The method of claim 1, further comprising performing the calibration by at least determining an offset value to adjust the position of the throttle.

5. The method of claim 4, wherein:

the offset value is determined during a calibration mode of the gas burner appliance with a defined number of the Venturi nozzles of the mixing device being closed and a defined number of the Venturi nozzles of the mixing device being opened, the offset value is used without adjustment for a regular combustion mode of the gas burner appliance in which the same number of the Venturi nozzles of the mixing device is closed and the same defined number of the Venturi nozzles of the mixing device is opened as in the calibration mode of the gas burner appliance in which the offset value has been determined, the offset value is used with adjustment for a regular combustion mode of the gas burner appliance in which a different number of the Venturi nozzles of the mixing device is closed and a different number of the Venturi nozzles of the mixing device is opened as in the calibration mode of the gas burner appliance in which the off-set value has been determined.

6. The method of claim 5, wherein for the adjustment of the offset value, the offset value is multiplied with a factor dependent upon the ratio between a flow section provided by the Venturi nozzles being open during the regular combustion mode of the gas burner appliance and a flow section provided by the Venturi nozzles or each Venturi nozzle being open during the calibration mode of the gas burner appliance in which the offset value has been determined.

7. The method of claim 1, wherein:

the air flow is provided by an air duct and a gas flow is provided by a gas duct, the fan sucks in the air flowing through the air duct and the gas flowing through the gas duct, the gas regulating valve and the throttle are positioned within the gas duct.

* * * * *